United States Patent [19]

Geschwender

[11] 4,208,070

[45] Jun. 17, 1980

[54] LEISURE CHAIR

[75] Inventor: Robert C. Geschwender, Lincoln, Nebr.

[73] Assignee: Concept Engineering, Inc., Lincoln, Nebr.

[21] Appl. No.: 945,856

[22] Filed: Sep. 26, 1978

[51] Int. Cl.[2] ..... A47C 13/00

[52] U.S. Cl. ..... 297/118; 5/432; 297/229

[58] Field of Search ..... 5/327 R, 327 B, 344; 297/1, 3, 219, 229, 378, 382, 118

[56] References Cited

U.S. PATENT DOCUMENTS

| | | | |
|---|---|---|---|
| D. 210,579 | 3/1968 | Hehn | D15/8 |
| 1,865,030 | 6/1932 | McCauley | 297/378 X |
| 2,429,795 | 10/1947 | Blanchard et al. | 297/118 |
| 2,857,957 | 10/1958 | Gay | 5/327 R |
| 2,914,116 | 11/1959 | Göhmann | 5/327 R |
| 3,120,008 | 2/1964 | Watson | 5/327 R |
| 4,064,580 | 12/1977 | Ezekoye | 5/327 B |

OTHER PUBLICATIONS

Certificate of Invention, Slominski et al., "TV EZ Chair", 7/28/56.

*Primary Examiner*—James C. Mitchell

*Attorney, Agent, or Firm*—Senniger, Powers, Leavitt and Roedel

[57] ABSTRACT

A leisure chair comprising a generally rectangular frame bent on a line extending transversely of the frame so as to be generally L-shaped as viewed from the side with support and backrest frame portions. The chair also includes a cover for the frame extending between opposite sides of the backrest frame portion, and a cushion swingable relative to the frame about the bend line of the frame. The chair may be used in two different positions on the floor, one in which the cover functions as a backrest and the cushion as a seat, and the other in which the cover presents a reclining surface and the cushion provides a headrest to one reclining on the surface.

9 Claims, 9 Drawing Figures

LEISURE CHAIR

BACKGROUND OF THE INVENTION

This invention relates generally to chairs and more particularly to a legless leisure chair which may be overturned from one position in which it functions as a conventional chair, having a backrest and a cushion extending from the backrest at the bottom of the backrest for providing a seat, to a second position in which the chair serves as a recliner, with the backrest presenting a reclining surface and the cushion providing a headrest for one reclining on the surface.

This invention represents an improvement over a prior art legless chair which, although generally similar to the chair of this invention, was not formed to enable it to be effectively used in both a "sitting" and "reclining" position. Reference may be made to U.S. Pat. Nos. 4,064,580 and Des. 210,570 for chairs generally in the field of this invention.

SUMMARY OF THE INVENTION

Among the several objects of this invention may be noted the provision of a legless leisure chair which may selectively be placed on a floor, for example, in one of two positions for either sitting or reclining on the chair on the floor; the provision of such a chair which is stable when resting on the floor in either of said two positions; the provision of such a chair which is readily movable from one position to the other; the provision of such a chair which is comfortable in use and pleasing in appearance; the provision of such a chair which is easy to clean; the provision of such a chair which is readily stackable with other chairs of this invention; and the provision of such a chair which is simple in design for economical manufacture.

Generally, a leisure chair of this invention comprises a generally rectangular frame bent on a line extending transversely of the frame so as to be generally L-shaped as viewed from the side with support and backrest frame portions, a cover for the frame adapted to extend between opposite sides of the backrest frame portion, and a cushion swingable relative to the frame about said bend line at the juncture of said support and backrest frame portions. The chair is adapted to be positioned on a floor in a first position in which the support portion of the frame rests horizontally on the floor and the backrest frame portion at one end of the support portion constituting its front end extends upwardly and rearwardly from said one end of the support portion with the cover providing a backrest, and in which said cushion extends forwardly from the frame and rests on the floor for providing a seat. The chair may be overturned from said first position to a second position in which the support portion of the frame extends upwardly from the floor and the backrest frame portion slopes downwardly from the upper end of the support portion to the floor with the cover presenting a reclining surface, the cushion being swingable to a position in which it rests substantially flat against said surface to provide a headrest for one reclining on said surface. The outer ends of the support and backrest frame portions are formed for non-rocking engagement with the floor when the chair is in said second position. Other objects and features will be in part apparent and in part pointed out hereinafter.

BRIEF DESCRIPTION OF THE DRAWINGS

Corresponding reference characters indicate corresponding parts through the several views of the drawings.

DESCRIPTION OF A PREFERRED EMBODIMENT

Figure 1:
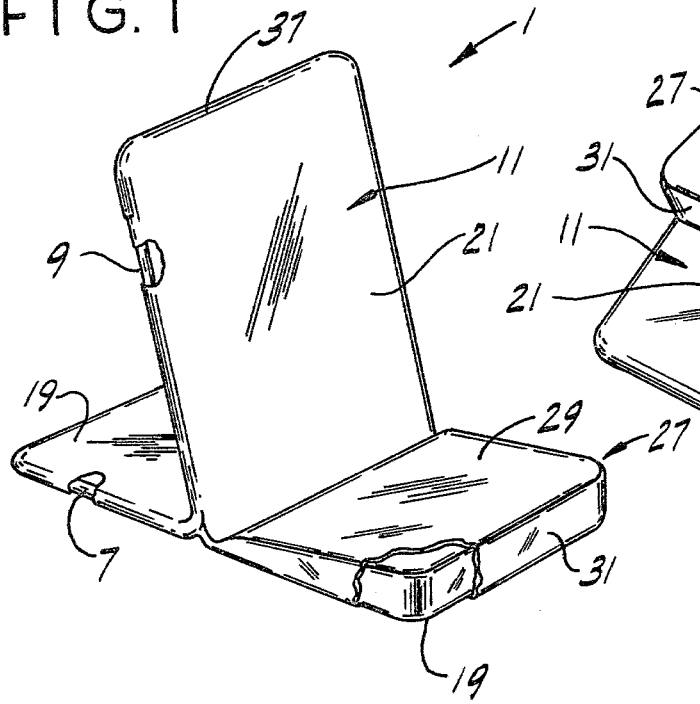
FIG. 1 is a perspective of a chair of this invention on the floor in a first "sitting" position.
Figure 3:
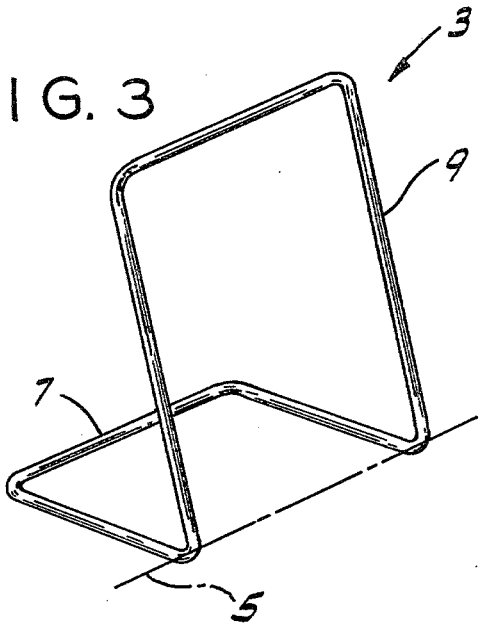
FIG. 3 is a perspective of the chair of FIG. 1 with the cover and cushion removed from the frame to illustrate the frame.

Referring now to the drawings, particularly to FIGS. 1 and 3, a leisure chair of this invention is designated generally by the reference numeral 1 and is shown to comprise a generally rectangular frame 3 bent along a line 5 extending transversely of the frame so as to be generally L-shaped as viewed from the side with support and backrest frame portions indicated at 7 and 9, respectively. As shown, the frame is a one-piece frame of bent round metallic tubing, although it will be understood that it could suitably be frabricated of solid bar or rod material as well. The chair also includes a cover 11 for the frame extending between opposite sides of the frame.

Figure 5:
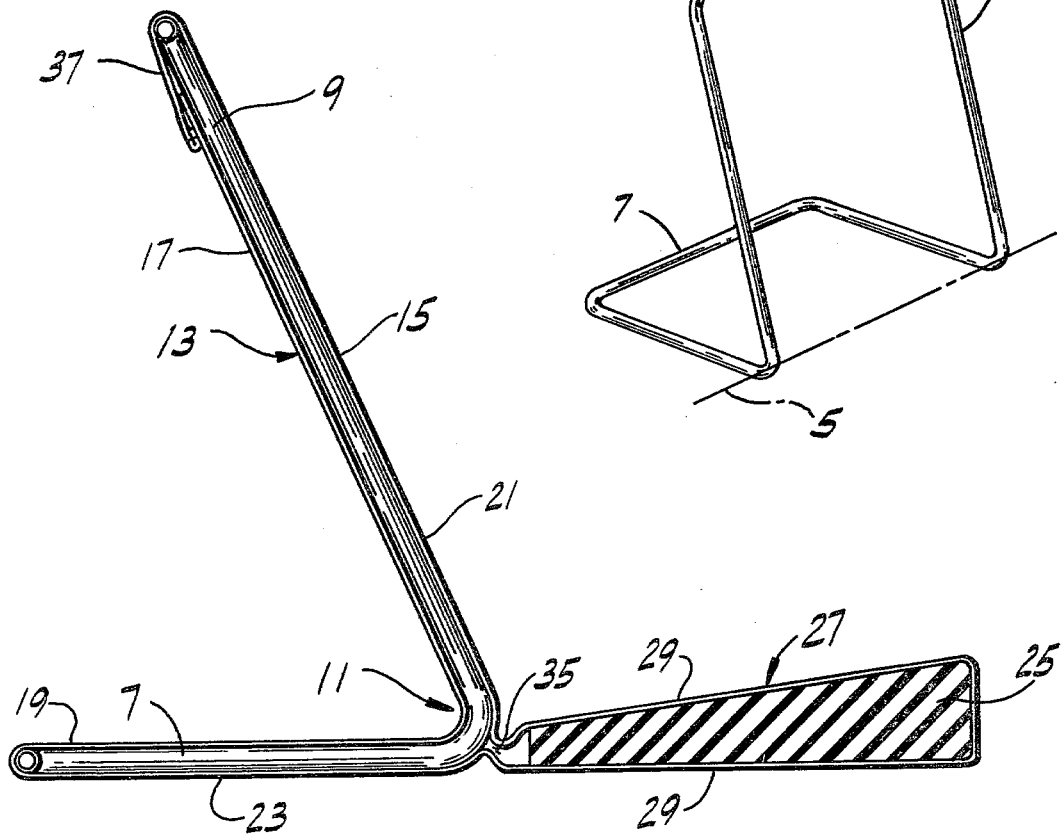
FIG. 5 is a section on line 5—5 of FIG. 4.

More particularly, the cover 11 is a removable cover generally tubular in shape and is of a flexible and preferably washable fabric. For example, if the chair is to be used indoors (as for reading or watching television), the cover may be fabricated of corduroy, and if it is to be used outdoors (as on the patio, beach, swimming pool, park, etc.), it may be of canvas or plastic. When on the frame 3, cover 11 covers both the support and backrest portions 7, 9 of the frame and has opposing walls, indicated generally at 13 and 15, extending between opposite sides of the frame. One of these walls, wall 13, comprises a first section 17 extending between opposite sides of the backrest frame portion 9 at the back (to the left as viewed in FIG. 5) of the latter, and a second section 19 formed integrally with the first section and extending between opposite sides of the support frame portion 7 above the latter. The other wall, wall 15, is also divided into corresponding first and second sections indicated at 21 and 23, respectively, section 21 being at the front (to the right) of the backrest frame portion, and section 23 being beneath the support frame portion. As shown in FIG. 5, these latter two sections 21, 23 are separate at their adjoining ends at the bend line 5 of the frame.

Indicated at 25 and swingable relative to the frame about bend line 5 is a cushion held in a pocket, generally designated 27, formed integrally with the cover 11 for the frame (see FIGS. 1 and 5). More particularly, this pocket 27 comprises a pair of rectangular extensions, each designated 29, extending in face-to-face relation outwardly (to the right) from the adjoining ends of sections 21, 23 and connected at their sides and at their outer ends by an elongate piece 31 of material. The mouth of pocket 27, defined by the adjoining but separate edges of sections 21, 23 of the frame cover 11, is indicated at 35. As shown, cushion 25 is generally wedge-shaped, increasing in thickness as it extends from the frame at the juncture of the support and backrest frame portion 7, 9 and is of a suitable cushioning material, such as foam rubber, for ensuring that the chair is comfortable in use.

The frame cover 11 is closed at one end and open at its other end allowing it to be slipped on and off the frame, and it has an integral end portion or flap 37 at its open end extending from the upper section 21 of wall 15 for covering the outer end of the backrest frame portion 9. As will appear hereinafter, this end portion 37 is eversible for removal from the end of the backrest frame portion thereby permitting the cover to be slipped off the frame.

Figure 2:
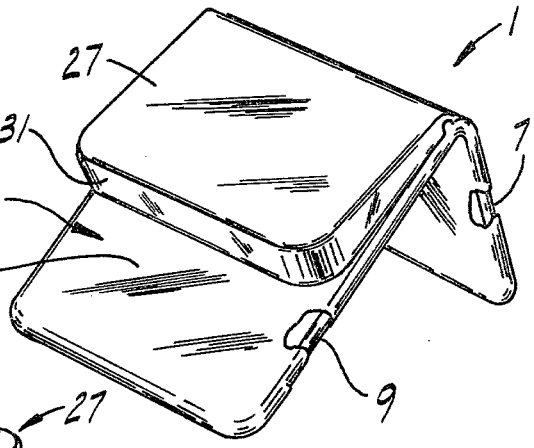
FIG. 2 is a perspective of the chair shown in FIG. 1 overturned to a second "reclining" position.
Figure 9:
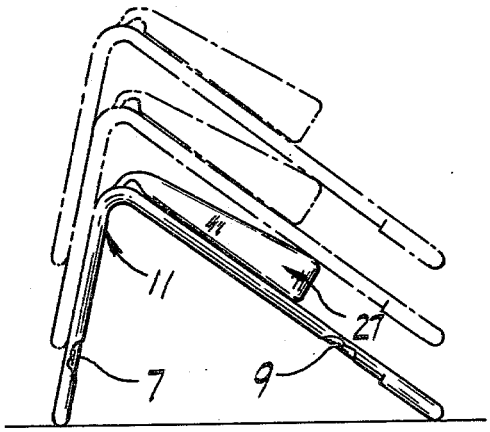
FIG. 9 is a view illustrating a plurality of chairs of this invention, stacked one on top of the other.

In accordance with this invention, the leisure chair may be positioned on the floor, for example, in one of two positions. In a first position, hereinafter referred to as the "sitting" position (FIGS. 1 and 5), the support portion 7 of the frame rests flat on the floor and the backrest frame portion 9 extends upwardly and rearwardly (to the left as viewed in FIG. 5) from the front (right) end of the support frame portion, an acute angle thus being formed between the support and backrest frame portions. The cushion 25 extends forwardly from the frame and rests on the floor for providing a seat and the cover 11 extending between opposite sides of the backrest frame portion 9 provides a backrest to one sitting on the cushion. The chair may readily be overturned on the floor to a second "reclining" position, shown in FIG. 2, in which the support portion 7 of the frame extends up from the floor and the backrest frame portion 9 slopes down from the upper end of the support portion to the floor with the cover 11 presenting a reclining surface. When the chair is in this position, the cushion 25 in its pocket 27 may be swung relative to the frame so that it rests substantially flat against section 21 of the cover to provide a headrest for one reclining on the chair. As shown best in FIG. 9, a plurality of chairs may be stacked one on top of the other in the reclining position.

It will be observed that the frame 3 of the chair of this invention is formed for non-rocking engagement with the floor when the chair is in its reclining position. More specifically, each of the corners of the generally rectangular frame are bent on a relatively small radius of curvature with the outer ends of the support and backrest frame portions 7, 9 between the corners being straight for non-rocking engagement with the floor. Thus, it will be apparent that the chair is stable when resting on the floor in either its sitting or reclining position. Other frame configurations may also be suitable for stably supporting the chair in either of these two positions.

Figure 6:
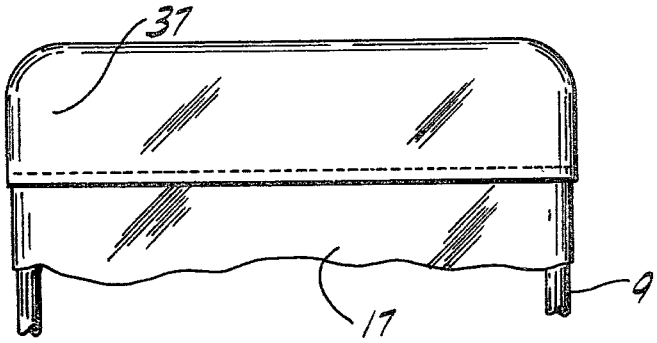
FIG. 6 is an enlarged view of a portion of FIG. 4.
Figure 4:
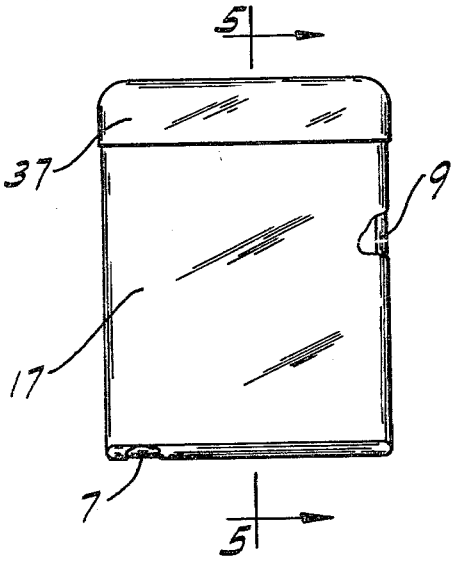
FIG. 4 is a left-end elevation of FIG. 1.
Figure 8:
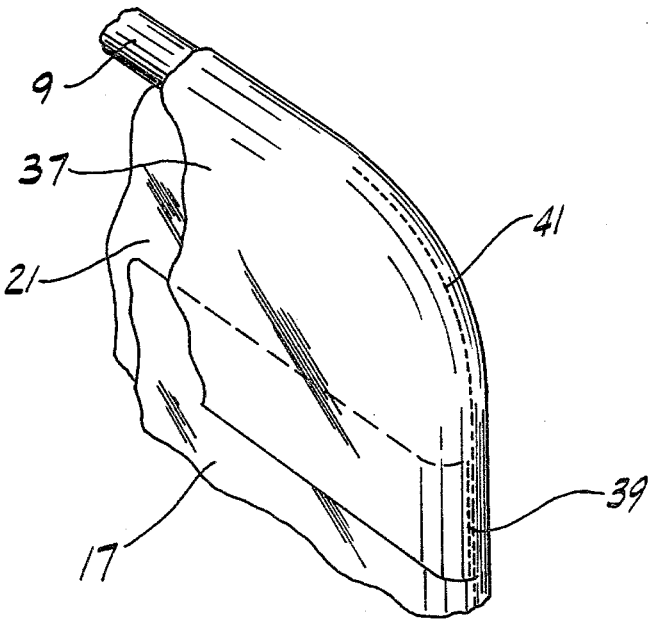
FIG. 8 is an enlarged perspective of the right end of FIG. 6, illustrating the construction of the cover.

The end portion or flap 37 at the outer end of section 21 of wall 15 of the frame cover 11 has a width approximately equal to that of the cover walls 13, 15 and, as shown best in FIGS. 5 and 6, extends from the upper section 21 of wall 15 up over the end of the backrest frame portion 9 and thence back down on the inside of section 21 with the outer end of the flap overlapping the upper margin of section 17 of wall 13 on the outside of that wall. The outer end of the flap is seamed to section 21 of wall 15 of the cover at the sides of the frame along the side margins of the flap, as shown at 39, thus forming a pocket with the outer end of the backrest frame portion 9 being received therein. The flap is also seamed at each of its sides along lines of stitching 41 (FIG. 8) so that it conforms to the round corners of the frame for enhancing the attractiveness of the chair.

Figure 7:
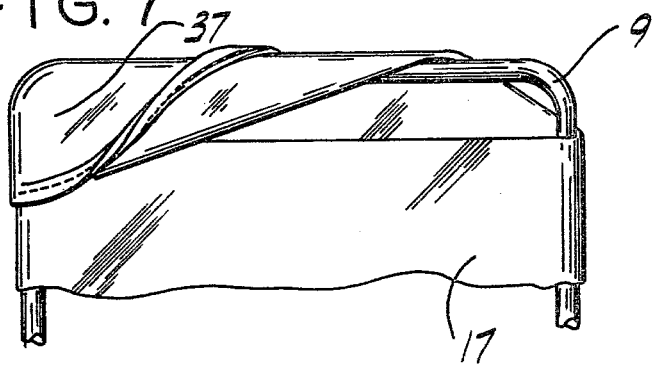
FIG. 7 is a view similar to FIG. 6 illustrating how the cover is removed from the frame.

The cover 11 is removable from the frame by pulling the outer end of flap 37 up over the outer end of the backrest frame portion 9 to an everted position on the outside of section 21 of wall 15 of the cover (see FIG. 7) thereby to allow the cover to be slipped off the frame to be cleaned. Prior to cleaning of the cover, the cushion 25 may be removed from its pocket 27 by pulling it through the mouth 35 of the pocket and thence out of the open end of the frame cover.

In view of the foregoing, it will be apparent that a leisure chair of this invention may be used for watching television, for example, in either a sitting or reclining position on the floor and is constructed to be stable when resting on the floor in either position. The fact that the cover 11 is removable and of a washable fabric is also advantageous inasmuch as it may be readily cleaned. And the simple design of the chair makes it pleasing in appearance as well as economical to produce. Moreover, storage of a plurality of chairs of this invention is facilitated since the chairs may be readily, stably and compactly stacked together in nested fashion (see FIG. 9).

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A leisure chair comprising a generally rectangular frame bent on a line extending transversely of the frame so as to be generally L-shaped as viewed from the side with support and backrest frame portions, a cover for the frame adapted to extend between opposite sides of the backrest frame portion, and a cushion swingable relative to the frame about said bend line at the juncture of said support and backrest frame portions, said chair being adapted to be positioned on a floor in a first position in which the support portion of the frame rests flat on the floor and the backrest frame portion at one end of the support portion constituting its front end extends upwardly and rearwardly from said one end of the support portion with the cover providing a backrest, and in which said cushion extends forwardly from the frame and rests on the floor for providing a seat, said chair being adapted to be overturned from said first position to a second position in which the support portion of the frame extends upwardly from the floor and the backrest frame portion slopes downwardly from the upper end of the support portion to the floor with the cover presenting a reclining surface, the cushion being swingable to a position in which it rests substantially flat against said surface to provide a headrest for one reclining on said surface, the outer ends of the support and backrest frame portions being formed for non-rocking engagement with the floor when the chair is in said second position, said cover being of relatively flexible material and generally tubular in shape, having opposing walls extending between opposite sides of the frame when the cover is on the frame and being open at one end for allowing the cover to be slipped on and off the frame, the cover further having a pocket formed integrally therewith for holding said cushion.

2. A leisure chair as set forth in claim 1 wherein the thickness of said cushion increases as it extends forwardly from the frame when the chair is in said first position.

3. A leisure chair as set forth in claim 1 wherein said cover is adapted to cover both said support and backrest frame portions.

4. A leisure chair as set forth in claim 1 wherein said cover is closed at its other end and has an end portion at its open end integrally formed with the cover for covering one end of the frame after the cover has been slipped on the frame, said end portion being eversible for removal thereof from said one end of the frame allowing the cover to be slipped off the frame.

5. A leisure chair as set forth in claim 4 wherein said end portion comprises a flap at the outer end of one of said walls having a width approximately equal to that of the walls, said flap being adapted to extend from said one wall of the cover over the end of the frame and thence back toward the other wall of the cover on the inside of said one wall with the outer end of the flap being seamed to one of the walls along the side margins of the flap, the cover being removable from the frame by pulling the flap over the end of the frame to an everted position on the outside of said one end wall thereby to allow the cover to be slipped off the frame.

6. A leisure chair as set forth in claim 5 wherein said flap is adapted to extend from said one end wall of the cover over the end of the frame and to overlap the other end wall of the cover, said flap being stitched to said one end wall of the cover along the side margins of the flap.

7. A leisure chair as set forth in claim 1 wherein each of said walls comprises a first section adapted to extend between opposite sides of the backrest frame portion and a second section adapted to extend between opposite sides of the support frame portion, the first and second sections of one wall being separate at their adjoining ends at said bend line and having extensions approximately of the same width as that of the sections extending in face-to-face relation from said adjoining ends, said extensions being connected along their sides and at their outer ends to form said pocket for receiving said cushion, the adjoining ends of said sections defining the mouth of said pocket.

8. A leisure chair as set forth in claim 7 wherein said cushion is removable from the pocket via the mouth of said pocket and the open end of the cover.

9. A leisure chair as set forth in claim 1 wherein said frame is a one-piece frame of bent tubing, and said cover is of a washable fabric material.

* * * * *